United States Patent [19]

Dix

[11] Patent Number: 4,885,435

[45] Date of Patent: Dec. 5, 1989

[54] CANTILEVER SPRING SWITCH HAVING MULTIPLE FULCRUMS

[75] Inventor: Willard A. Dix, Noblesville, Ind.

[73] Assignees: American Telephone and Telegraph Company, New York, N.Y.; AT&T Information Systems Inc., Morristown, N.J.

[21] Appl. No.: 289,091

[22] Filed: Dec. 23, 1988

[51] Int. Cl.[4] ..... H01H 21/80

[52] U.S. Cl. ..... 200/1 B; 200/6 B; 200/6 BB; 200/6 C; 200/559

[58] Field of Search ..... 200/1 A, 1 B, 5 R, 6 R, 200/6 B, 6 BB, 6 C, 241, 292, 339, 402, 405, 408, 409, 509, 510, 533–535, 542, 545, 551, 558, 559, 568; 379/422–424, 427

[56] References Cited

U.S. PATENT DOCUMENTS

| | | | |
|---|---|---|---|
| 2,958,752 | 11/1960 | Horman | 200/535 |
| 3,562,464 | 2/1971 | Vollum et al. | 200/292 X |
| 3,619,532 | 11/1971 | Lyvang | 200/292 X |
| 3,764,762 | 10/1973 | Roeser | 200/533 X |
| 3,900,709 | 8/1975 | Sheesley et al. | 200/5 R |
| 4,070,555 | 1/1978 | Carli | 200/6 B |
| 4,081,632 | 3/1978 | Schaffeler | 200/6 BB |
| 4,099,037 | 7/1978 | Hartzler et al. | 200/5 A |
| 4,395,609 | 7/1983 | Sowash | 200/6 B X |
| 4,424,420 | 1/1984 | Haskins | 379/424 |

*Primary Examiner*—A. R. Scott

*Attorney, Agent, or Firm*—Michael A. Morra

[57] ABSTRACT

A manually operated switch that combines spring and contact functions in a low profile, machine-insertable component. The switch readily mounts onto a printed wiring board. It includes a cantilevered leaf spring member having one free end and a pair of spaced-apart fulcrums at the other end; one of the fulcrums being at the point of attachment of the leaf spring to the printed wiring board and the other being a re-entrant bend in the leaf spring in the vicinity of its center. An actuator is positioned to apply a force between the fulcrums such that the free end moves in a direction opposite to the direction of the applied force. Each spring member in combination with suitably placed contact pads is capable of providing a separate switch operation such as: "make" operation, "break" operation, or make-before-break "transfer" operation. A single actuator operates one or more spring members, each independently providing a different one of the above-described switch operations.

14 Claims, 4 Drawing Sheets

FIG. 1
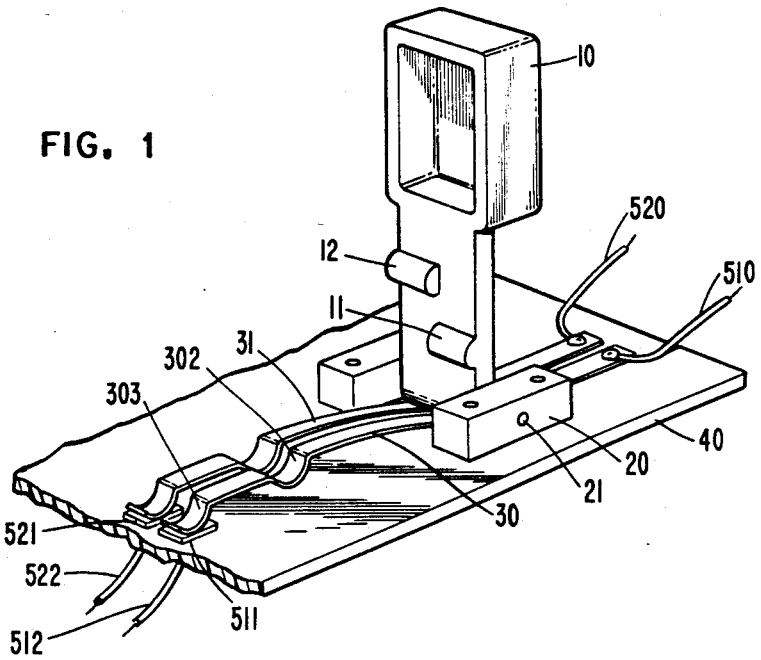
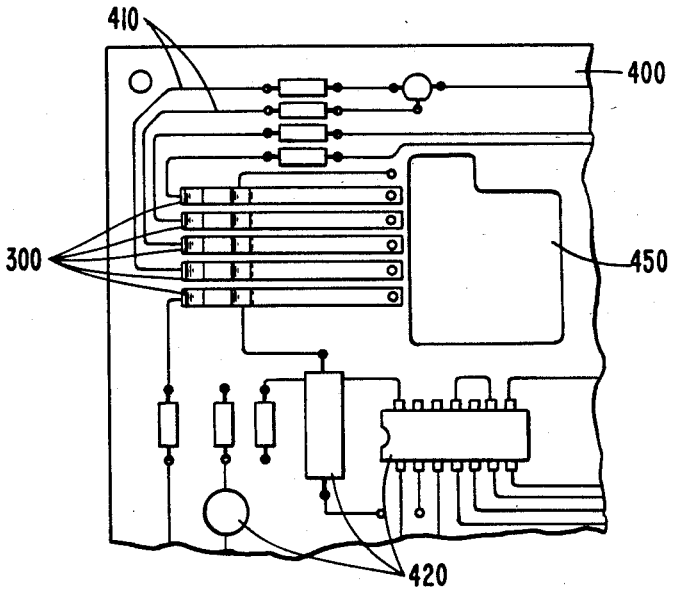
FIG. 12

FIG. 2
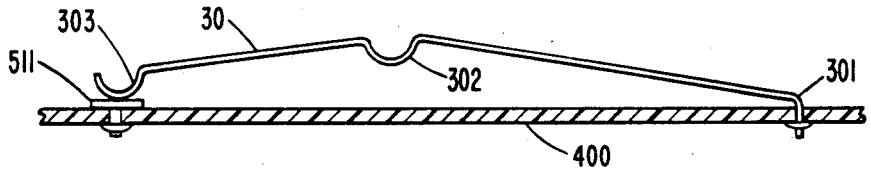
FIG. 3
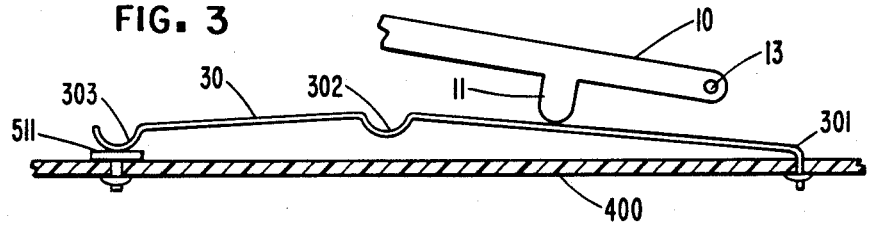
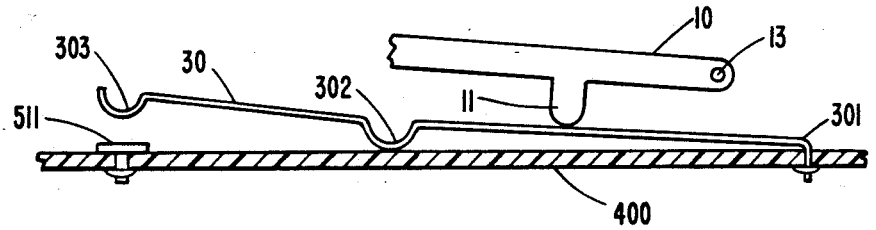
FIG. 4

CANTILEVER SPRING SWITCH HAVING MULTIPLE FULCRUMS

TECHNICAL FIELD

This invention relates to electrical switches, and more particularly to cantilever leaf spring contacts used therein.

BACKGROUND OF THE INVENTION

It is desirable to have an electrical switch wherein a single arrangement can provide, depending on where the contacts are located, a switch that: (i) is normally open and closes upon activation; (ii) is normally closed and opens upon activation; or (iii) includes a pair of contacts, one being normally open and the other being normally closed, which reverse their respective states upon activation.

Additionally, because of space limitations on a printed wiring board (PWB), it is desirable to provide switching functions in a low profile configuration that mounts onto a PWB. In a telephone set, for example, switches are used to interface between user operated keys, such as a switchhook, and electronic circuitry on the PWB. Such switches frequently include their own special packaging which is not readily adapted to the mechanical configuration of the telephone set.

In U.S. Pat. No. 4,099,037, etitled "Keyboard Switch Assembly Having Cantilevered Leaf Spring Contact Assembly on Common Conductive Frame," pushbutton type keys are shown activating a plurality of normally-open contacts. These contacts are members of a unitary frame, riveted to a substrate over an insulative layer. Although switch packaging is streamlined for telephone set applications, the use of rivets and insulative layers is undesirable. Further, only normally-open (make) contacts are shown, whereas ormally-closed (break) contacts are desirable in many applications. Indeed, mixing make and break contacts in the same keyboard does not appear feasible using the switch structure of the aforementioned patent without introducing another substrate positioned above the unitary frame.

Accordingly, it is an object of the present invention to provide a low cost, low profile electrical switch.

It is another object of the present invention to provide a switch having a plurality of spring members, mounted onto a single substrate, and capable of providing both normally-open and normally-closed contacts.

SUMMARY OF THE INVENTION

The present invention is directed to a switch that combines spring and contact functions in a low profile component. The switch comprises a cantilevered spring member and a centrally positioned fulcrum. An actuator is positioned to apply a force between the fulcrum and the fixed end of the cantilevered spring member such that the free end moves in a direction opposite to the direction of the applied force.

In illustrative embodiments, the spring member has a curved shape with one end inserted into a slot on a printed wiring board. The inserted (fixed) end makes electrical contact with a conductive path located on the printed wiring board. The free end makes mechanical contact with the printed wiring board.

In one illustrative embodiment, the centrally positioned fulcrum comprises a re-entrant bend in the spring member that operates as a normally-open contact which is closed when the actuator applies force to the spring member.

In another illustrative embodiment, the free end of the spring member operates as a normally-closed contact that is opened when the actuator member applies force to the spring member.

It is a feature of the present invention that each spring member can provide a pair of contacts with make-before-break operation.

It is another feature of the present invention that multiple spring members can be operated by the same actuator, each spring member being either a normally-opened or normally-closed switch depending upon where its associated contacts are located.

These and other objects and features of the present invention will be more fully understood when reference is made to the attached drawing and detailed description.

BRIEF DESCRIPTION OF THE DRAWING

FIG. 1 discloses a pair of leaf spring contacts in accordance with the invention in combination with an actuator member;

FIG. 2 discloses a side view of a normally-closed spring contact in accordance with the invention;

FIG. 3–4 are side views of a normally-closed spring contact and actuator member in two sequential positions of operation;

FIG. 12 discloses, in greater detail, the layout of the printed wiring board used in the telephone set of FIG. 9-11.

DETAILED DESCRIPTION

Figure 5:
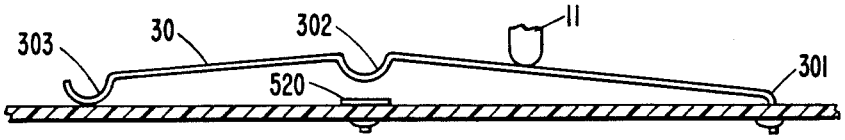
FIG. 5 is a side view of a normally-open spring contact in accordance with the invention.

FIG. 1 discloses a switch having a pair of normally-closed leaf spring contacts 30,31 in accordance with the invention. Each of the spring members 30,31 comprises an elongated, flat, rectangular piece of metal stock. In order for the spring members to be deflected and return to their original positions, the metal stock used is phosphor bronze. Spring members 30,31 are inserted into substrate 40 at one end thereof in a cantilever configuration. Thus, in the normal, non-operated state of spring member 30, electrical connection between wires 510 and 512 is made through spring member 30 and contact pad 511. Similarly, in the normal, non-operated state of spring member 31, electrical connection between wires 520 and 522 is made through spring member 31 and contact pad 521.

Focusing on the structure of spring member 30, for example, it includes a pair of re-entrant bends 302, 303 which are advantageously used to make contact and/or provide a mechanical fulcrum in the operation of the switch. Re-entrant bend 303 is plated with a precious metal in order to make good electrical contact with pad 511. The concave shape of re-entrant bend 303 provides a line of contact with pad 511.

Actuator 10 is attached to substrate 40 with a pair of mounting blocks 20. The mounting blocks and the actuator include holes which are aligned for receiving a steel pin 21 which pivotally joins the actuator and the mounting blocks together. As noted above, spring members 30 and 31 are mechanically attached to the substrate 40 at one end only in a cantilevered configuration. As shown in FIG. 1, this mechanical attachment occurs in the region where wires 510, 520 attach to the spring member. Actuator 10 further includes a pair of ribs 11, 12 which are positioned to sequentially operate spring contacts 30, 31 respectively.

FIG. 2 discloses, in greater detail, the structure of a single spring 30 and is used to further define terminology. Spring 30 is attached to substrate 400 at its fixed end 301 where mechanical connection is made, but also where electrical connection might also be made. Substrate 400 may be a printed wiring board containing other components as well as wiring pads deposited or etched thereon. It can be appreciated that the spring member need take up no more room than any other electrical component and thus provides a low profile switch. Further, such direct mounting to a printed wiring board eliminates the extra cost of a separately packaged switch as well as the additional electrical and mechanical connections required in attaching it to the printed wiring board. Spring member 30 is illustratively shown to be generally curved so that it is in physical contact with substrate 400 at each end but raised up from the substrate in its middle. Spring member 30 is connected to contact pad 511 as a normally-closed contact. Re-entrant bend 303 is positioned at the free end of the cantilever structure. Pad 511 comrises a metallized area to render it electrically conductive. In this illustrative embodiment the metallization passes through a hole in substrate 400 in order to interconnect normally-closed contacts 303,511 with printed wiring paths or wires on the bottom side of the substrate. As will be shown in connection with FIG. 12, normally-closed contacts 303,511 may also interconnect with other printed wiring board components and paths on the top side of the substrate.

FIG. 3 introduces an actuator 10 that cooperates with spring member 30 to provide the functions of a switch. As described in connection with FIG. 1, actuator 10 is pivotally attached to a mounting block. A steel pin passes through hole 13 in the actuator. As the actuator pivots downwardly, rib 11 makes mechanical contact with spring member 30 pushing it downwardly also. Such downward movement advantageously causes re-entrant bend 303 to make wiping contact with pad 511 as it moves laterally in response to the downward movement of the actuator. Wiping action operates to clean the contact surfaces.

FIG. 4 shows the position of spring member 30 after further downward travel of the actuator 10. After re-entrant bend 302 positioned at about the center of the spring member makes mechanical contact with substrate 400, any further downward pressure on the spring from rib 11 causes the free end of the spring 30 to rise up and break contact with pad 511. Re-entrant bend 302 thus operates as a fulcrum. Up until this time, fixed end 301 was the fulcrum since it was the point around which the spring member 30 rotated. It is important to note at this juncture that re-entrant bend 303 is positioned at the free end of spring member 30 and can be engineered to break contact with pad 511 at any one of various operating positions in the rotation of actuator 10 by selective placement of re-entrant bend 302 and/or selective placement of rib 11. Indeed, FIG. 1 illustrates selective placement of ribs 11 and 12 to cause spring members 30 and 31 to be operated, one before the other, in a predetermined sequence.

Other contact configurations are disclosed in FIG. 5–8 that illustrate the variety of applications possible in accordance with the present invention. For example, FIG. 5 discloses a simple "make" contact wherein re-entrant bend 302 makes contact with pad 520 in response to the downward movement of rib 11.

Figure 6:
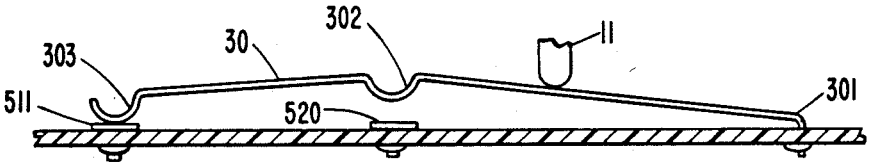
FIG. 6 is a side view of a make-before-break spring contact in accordance with the invention.

Combining make and break functions in a single spring member is disclosed in FIG. 6, where re-entrant bend 302 makes contact with pad 520 before re-entrant bend 303 breaks contact with pad 511. Here spring member 30 operates as a transfer contact in a make-before-break switch. When a make contact is not needed, re-entrant bend 302 may be replaced by a fulcrum built into the substrate such as illustrated in FIG. 7.

Figure 7:
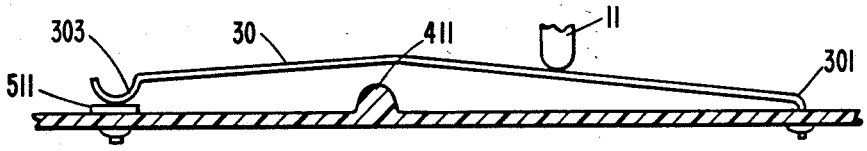
FIG. 7 is a side view of a normally-closed spring contact in accordance with the invention wherein a fulcrum is made part of the substrate.

Referring to FIG. 7, fixed end 301 initially provides the fulcrum around which the entire spring member 30 pivots until it makes contact with fulcrum 411; thereafter two fulcrums are operative: (i) fulcrum 301 provides a pivot point around which a first portion of spring member 30 rotates—that portion being the region between fixed end 301 and rib 11, and (ii) fulcrum 411 provides a pivot point around which a second portion of spring member 30 rotates—that portion being the region between re-entrant bend 303 and rib 11. Fulcrum 411 comprises a protrusion in the otherwise smooth surface of the substrate. When the substrate is a stand-alone dielectric housing, fulcrum 411 may be molded into the surface itself somewhere between the free and fixed ends of the spring member. When the substrate is a printed wiring board, fulcrum 411 may be a component such as a resistor. This component is preferably not electrically connected to other components, although one having sufficient mechanical strength and dielectric insulation could be advantageously used.

Figure 8:
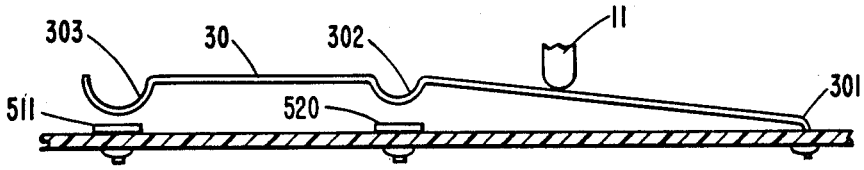
FIG. 8 discloses a spring member having two normally-open contacts that close in sequence, one of which re-opens thereafter.

Yet another application of the present invention is discussed in connection with FIG. 8 wherein spring member 30 is suitably shaped and anchored at fixed end 301 so that contact elements 302,520 and contact elements 303,511 are normally open. Re-entrant bend 303 is made larger than re-entrant bend 302 to cause the contact elements 303,511 to make before contact elements 302,520 as rib 11 travels downwardly. Upon further downward travel of rib 11, contact elements 303,511 reopen. Thus, during the downward movement of an actuator, three switch operations may be sequentially made by a single spring member. This same operation is possible when re-entrant bends 302 and 303 are of the same size; in that case it is only necessary to reshape the general curvature of spring member 30.

Finally, and most importantly, a single actuator may operate a plurality of spring members, each independently providing a different one of the switch operations taught in FIG. 4–8. A particularly desirable application of a switch having multiple spring members operated by a single actuator is in the line switch of a telephone set which is hereinafter discussed in connection with FIG. 9–12.

Figure 9:
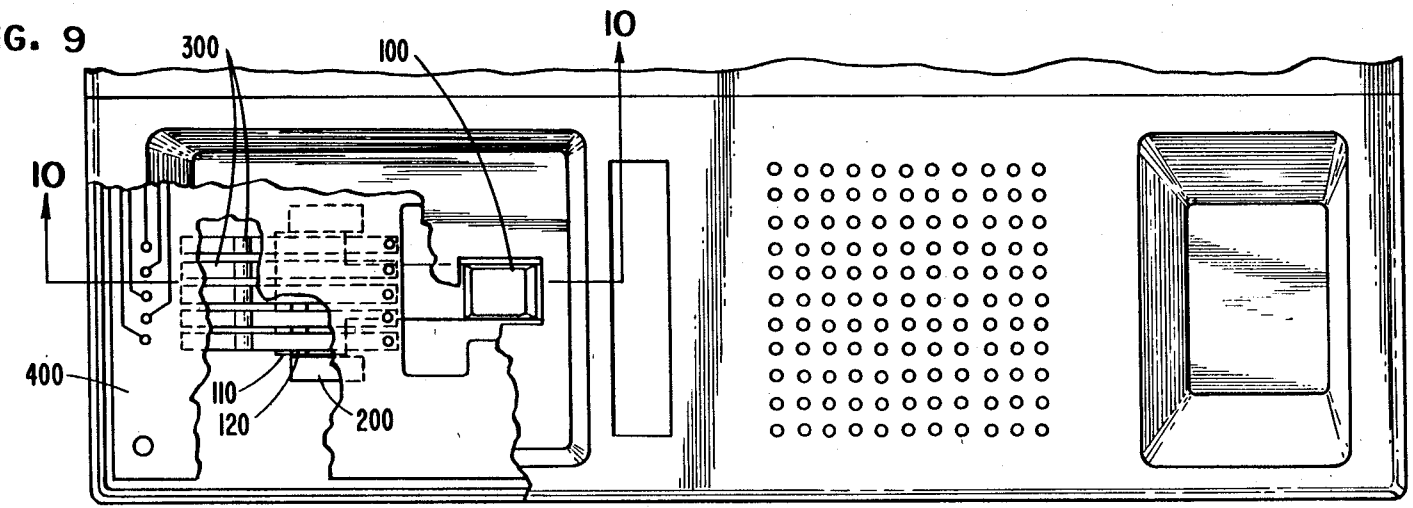
FIG. 9 discloses multiple leaf spring contacts being used in a line switch application within a telephone set.

In particular, the portion of a telephone set base that accommodates a telephone handset is shown in FIG. 9. A cut-open section of the telephone set base reveals printed wiring board 400 upon which spring members 300 are mounted. Actuator 100 is a line switch, held in place by mounting block 200 which is anchored to the telephone set base. Ribs 110 and 120 are molded into the structure of actuator 100. When the telephone handset (not shown) is placed on the base, actuator 100 is depressed downwardly so as to cause spring members 300 to be in their operated state. The weight of the handset is carefully selected to overcome the combined restoring force of the spring members 300.

Figure 10:
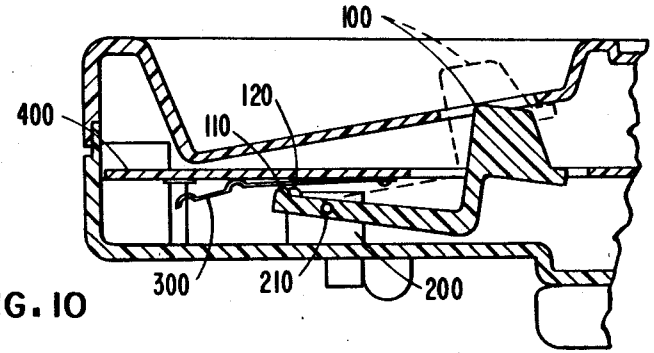
FIG. 10 discloses a cross-section view of FIG. 9 illustrating the interaction between a line switch plunger and multiple spring contacts in a preferred embodiment of the invention.

A cross-section of FIG. 9 in the region of actuator 100 is shown in FIG. 10. Actuator 100 is shown by solid lines in its "on-hook" position when the handset is on the base. Actuator 100 pivots around pin 210 to sequentially operate spring members 300, mounted on printed wiring board 400, via ribs 110, 120. In the position shown, all of the spring members are operated. Actuator 100 is shown by dotted lines in its "off-hook" position when the handset and base are separated. The restoring force of the spring members 300 pushes actuator 100 into this position. The weight of the telephone handset and the mechanical leverage possible through proper positioning of pivot pin 210 combine to assure that the individual spring members will be in the desired position during the on-hook and off-hook states of the telephone set.

Figure 11:
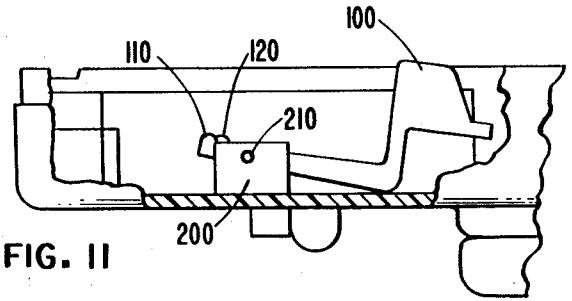
FIG. 11 shows the cross-section view of FIG. 10 after removal of the printed wiring board holding the multiple spring contacts.

FIG. 11 offers a less detailed picture of the cross-section shown in FIG. 10, but with the printed wiring board 400 removed. Note the rest position of actuator 100 when no spring members are present. The restoring force of the spring members advantaeously eliminate the need for coil springs that are typically associated with telephone set line switches.

A more detailed look at the printed wiring board 400 containing the spring members 300 is provided in FIG. 12. Components 420 are interconnected with each other ad with spring members 300 over printed wiring paths 410. A hole 450 in the printed wiring board is positioned to allow a portion of actuator arm 100 (see FIG. 9–11) to move through it. Hole 450 is irregularly shaped so that the reader can appreciate its orientation (i.e., in FIG. 12 the printed wiring board is shown with components facing upward, whereas in FIG. 9 the components are facing downward). The particular operations achieved by each of the spring members 300 is unspecified in FIG. 12, although, as indicated previously, each of the spring members may provide a different one of the various applications disclosed in FIG. 4–8.

Although various embodiments of the present invention have been shown, it is understood that modifications are possible within the spirit and scope of the invention. Such modifications include, but are not limited to: the placement of one or more spring members into a separate housing for use as a stand-alone switch; and the use of parallel substrates that "sandwich" one or more spring members, one substrate holding the spring members while the other is positioned to make electrical contact with them when they are operated, similar to relay operation.

I claim:

1. In combination:

a printed wiring board having a plurality of electronic components located thereon, the printed wiring board further including electrical paths interconnecting said electronic components, and holes for receiving said electrical components;

an electrically conductive spring member having one end thereof inserted into a hole in the printed wiring board where connection to a first electrical path is made, the spring member including a contact at an other end thereof that normally makes electrical connection to a second electrical path on the printed wiring board, the spring member further including a downward protrusion between the ends of the spring and positioned between the spring and the printed wiring board but not normally touching the printed wiring board; and an actuator, operative for applying a downward force to the spring member between its downward protrusion and said one end thereof, the actuator functioning to drive the protrusion into contact with the printed wiring board thereby causing said other end of the spring member to break its electrical connection with the second electrical path.

2. The combination of claim 1 further including a third electrical path on the printed wiring board positioned under the downward protrusion of the spring member, said downward protrusion being electrically conductive and providing a normally open contact which closes upon operation of the actuator.

3. In combination:

a printed wiring board having a plurality of electronic components located thereon, the printed wiring board further including electrical paths interconnecting said electronic components and holes for receiving said electrical components;

an electrically conductive spring member having one end thereof inserted into a hole in the printed wiring board where connection to a first electrical path is made, the spring member having a generally concave shape relative to the printed wiring board such that mechanical contact with the printed wiring board normally only occurs at the ends of the spring member, the spring member further including a downward protrusion between the ends thereof that is electrically conductive and positioned directly above, but not in contact with, a second electrical path on the printed wiring board; and an actuator for applying a downward force to the spring member between its downward protrusion and one of the ends thereof, the actuator functioning to drive the protrusion into electrical connection with said second electrical path so that a normally open contact closes upon activation of the actuator.

4. A normally-closed switch comprising:

an electrically conductive leaf spring;

a dielectric substrate including first and second conductive areas for making electrical contact with predetermined portions of the leaf spring;

the leaf spring being attached at one end to the dielectric substrate but free at the other end to move away from the substrate, the leaf spring including a protrusion positioned between the ends thereof and facing the substrate, the leaf spring making electrical contact with the first conductive area at its attached end and making electrical contact with the second conductive area at its free end; and an actuator, positioned to engage the leaf spring between the attached end and the protrusion such that after engaging the leaf spring the free end breaks contact with the second conductive area.

5. A transfer switch comprising:

an electrically conductive leaf spring;

a dielectric substrate including first, second and third conductive areas for making electrical contact with predetermined portions of the leaf spring;

the leaf spring being attached at one end to the dielectric substrate but free at the other end to move away from the substrate, the leaf spring including a protrusion positioned between the ends thereof and facing the substrate, the leaf spring making electrical contact with the first conductive area at its attached end and making electrical contact with the second conductive area at its free end; and an actuator, positioned to engage the leaf spring between the attached end and the protrusion such that after engaging the leaf spring the protrusion makes electrical contact with the third conductive area and, thereafter, the free end breaks contact with the second conductive area.

6. A switch for providing sequential operations comprising:

a pair of electrically conductive leaf springs, each being attached at one end thereof to a dielectric substrate but free at the other end to move away from the substrate, each of said free ends initially being in electrical contact with a metallic element on the substrate, each leaf spring including a protrusion positioned between the ends thereof and facing substrate; and an actuator including a pair of ribs, each positioned to engage one of the leaf springs at a different position along the length of the leaf spring between its attached end and its protrusion; whereby, after engagement, the ribs make sequential mechanical contact with the leaf springs and thus cause the free ends to break electrical contact with the metallic elements in a predetermined sequence.

7. A switch for providing sequential operations comprising:

a pair of electrically conductive leaf springs, each being attached at one end thereof to a dielectric substrate but free at the other end to move away from the substrate, the substrate including first and second metallic elements positioned beneath the free ends of the leaf springs for making electrical contact therewith, one of said free ends initially being in electrical contact with the first metallic element on the substrate and the other of said free ends not initially being in electrical contact with the second metallic element; and an actuator including a pair of ribs, each posistioned to engage one of the leaf springs at a different position along the length of the leaf spring between its attached end and the protrusion in the substrate; whereby, after engagment, the ribs make sequential mechanical contact with the leaf springs and thus cause the free ends to break and make electrical contact with the first and second metallic elements in a predetermined sequence.

8. An electrical switch comprising;

an elongated spring member having one end free and being attached at its other end to a base member, the spring member including an electrically conductive area at the free end and further including a protrusion, positioned between the attached end and the free end, that extends toward the base member;

a member for applying a force to the spring member in a direction that drives the spring member toward the base member, the force being applied at a point between the attached end and the protrusion, said force causing the free end to move away from the base member after the protrusion has made physical contact with the base member; and a first metallic element, positioned on the base member so as to "make" and "break" electrical contact with the electrically conductive area at the free end of the spring member in response to movements of the spring member.

9. The electrical switch as in claim 8 wherein electrical connection is made to the spring member at its attached end.

10. The electrical switch as in claim 8 wherein the electrically conductive area at the free end of the spring member and the first metallic element are in electrical contact before force is applied to the spring member by the force applying member.

11. The electrical switch as in claim 8 wherein the electrically conductive area at the free end of the spring member and the first metallic element are not in electrical contact before force is applied to the spring member by the force applying member.

12. The electrical switch as in claim 8 wherein the electrically conductive area at the free end of the spring member comprises a re-entrant bend formed in the spring member.

13. The electrical switch as in claim 8 wherein the protrusion comprises a re-entrant bend formed in the spring member.

14. The electrical switch as in claim 8 wherein the base member further includes a second metallic element, positioned on the base member so as to "make" and "break" electrical contact with the protrusion on the spring member in response to movements of the spring member.

* * * * *